US009579246B2

(12) United States Patent
Shepherd

(10) Patent No.: US 9,579,246 B2
(45) Date of Patent: Feb. 28, 2017

(54) MOUNTING BRACKET

(71) Applicant: Casey Shepherd, San Antonio, TX (US)

(72) Inventor: Casey Shepherd, San Antonio, TX (US)

(73) Assignee: Instrument Specialists, Inc., Boerne, TX (US)

( * ) Notice: Subject to any disclaimer, the term of this patent is extended or adjusted under 35 U.S.C. 154(b) by 825 days.

(21) Appl. No.: 13/781,128

(22) Filed: Feb. 28, 2013

(65) Prior Publication Data

US 2014/0238408 A1 Aug. 28, 2014

(51) Int. Cl.

| | |
|---|---|
| ***A61G 13/12*** | (2006.01) |
| ***A61G 13/10*** | (2006.01) |
| ***A61G 13/08*** | (2006.01) |
| *A61G 7/05* | (2006.01) |
| *A61G 7/075* | (2006.01) |
| *A61G 13/00* | (2006.01) |

(52) U.S. Cl.

CPC ..... *A61G 13/101* (2013.01); *A61G 13/08* (2013.01); *A61G 13/129* (2013.01); *A61G 13/1235* (2013.01); *A61G 7/0507* (2013.01); *A61G 7/075* (2013.01); *A61G 2013/0045* (2013.01)

(58) Field of Classification Search

CPC ..... A47C 13/00; A47C 19/005; A47C 19/021; A47C 20/00; A47C 20/02; A47C 20/023; A61F 13/00; A61F 13/0089; A61F 13/02; A61G 13/00; A61G 13/10; A61G 13/12; A61G 13/1235; A61G 13/124; A61M 25/00; A61M 25/01; A61M 25/02

USPC ... 5/600, 613, 617, 621, 623, 630, 632, 646, 5/279.1, 286, 287, 304; 128/845, 846, 128/869, 877, 878

See application file for complete search history.

(56) References Cited

U.S. PATENT DOCUMENTS

| | | | | | |
|---|---|---|---|---|---|
| 3,046,072 | A * | 7/1962 | Douglass, Jr. | A61G 13/12 | 5/623 |
| 3,339,913 | A * | 9/1967 | Anderson | A61G 13/12 | 248/298.1 |
| 4,545,573 | A * | 10/1985 | Murphy | A61G 13/12 | 269/131 |
| 4,886,258 | A * | 12/1989 | Scott | A61G 13/12 | 5/624 |
| 5,390,383 | A * | 2/1995 | Carn | A61G 13/12 | 128/877 |
| 5,718,671 | A * | 2/1998 | Bzoch | A61G 5/12 | 128/878 |
| 6,059,366 | A * | 5/2000 | Hu | B60N 2/46 | 297/411.31 |

(Continued)

*Primary Examiner* — Ophelia A Hawthorne

(74) *Attorney, Agent, or Firm* — Bushman Werner, P.C.

(57) ABSTRACT

A clamping bracket which can be used to clamp an armboard on the side rail of an operating table. The clamping bracket has an attachment assembly connected to a base, the base being attached to the armboard. The attachment assembly includes a locking assembly to selectively lock the attachment assembly at a desired location along the length of the base and a clamping assembly to receive and compressively grip the side rail, thereby forming a rigid attachment of the armboard assembly to the side rail of the operating table. In a preferred embodiment, there are two attachment assemblies and, accordingly, two locking assemblies and two clamping assemblies.

13 Claims, 4 Drawing Sheets

(56) References Cited

U.S. PATENT DOCUMENTS

| | | | | |
|---|---|---|---|---|
| 6,195,820 | B1 * | 3/2001 | Heimbrock | A61G 13/12 403/68 |
| 6,499,158 | B1 * | 12/2002 | Easterling | A61G 15/10 248/231.61 |
| 6,708,935 | B2 * | 3/2004 | Smeed | A61G 5/12 128/878 |
| 7,003,827 | B2 * | 2/2006 | DeMayo | A61G 13/10 248/229.14 |
| 7,150,504 | B1 * | 12/2006 | Lee | A47C 1/03 297/411.35 |
| 7,234,779 | B2 * | 6/2007 | Bedford | A47C 1/03 297/344.16 |
| 7,686,267 | B2 * | 3/2010 | DaSilva | A61B 17/02 248/228.5 |
| 9,022,334 | B1 * | 5/2015 | DeMayo | A61G 13/101 248/229.22 |

* cited by examiner

MOUNTING BRACKET

FIELD OF THE INVENTION

The present invention relates to mounting brackets for connecting first and second objects or members together and, more particularly, to a bracket for connecting surgical limb supports, especially armboards, to the side rail of an operating table.

BACKGROUND OF THE INVENTION

Description of the Prior Art

During surgical operations on a patient's arm, it is often necessary for the arm to be extended away from the body. This allows the surgeon to access the arm from the desired angle to achieve the goal of the particular surgery. To accomplish this, surgeons employ armboards which extend laterally outwardly from the operating table.

Some armboards are permanently attached to the table and they can be pivoted laterally outwardly when needed. These suffer from the disadvantage of not being movable along the length of the operating table should the patient be of a particular height such that the patient's arm does not coincide with the location of the armboard.

Most armboards are generally separate pieces, not permanently secured to the operating table. One such type of armboard is a freestanding apparatus which has legs to support it, and which can be placed where needed to support the patient's arm. This model of armboard is susceptible to being jarred out of place during the surgery as it is not actually attached to the operating table.

Other types of armboards are secured to the railing of the operating table through various types of mounting brackets or clamps attached to the armboard. They are more compact and not susceptible to being knocked over during surgery as are leg supported armboards. However, the placement of such armboards is limited depending on the location of the armboard brackets which are in a first position on the armboard and the location of the connections of the rail to the operating table. Thus, for example, the ideal position of the patient's arm relative to the operating table during surgery may not be achievable due to the connecting standoffs between the operating table rail and the operating table which limit where the bracket carrying the armboard can be attached to the rail.

SUMMARY OF THE INVENTION

In one aspect, the present invention provides an adjustable mounting bracket to connect first and second members to one another.

In another aspect, the present invention provides an adjustable mounting bracket to allow for various mounting locations on an operating table rail or the like.

In another aspect, the present invention provides an adjustable armboard assembly for connecting to the side rail of an operating table at a desired location.

These and further features and advantages of the present invention will become apparent from the following detailed description, wherein reference is made to the figures in the accompanying drawings.

DETAILED DESCRIPTION OF PREFERRED EMBODIMENTS

While the present invention will be described with respect to a mounting bracket for use in connecting an armboard or other support to the side rail of an operating table, it is to be understood that it may be used to connect other objects or members together where adjustability of one of the objects or members relative to the other is necessary or desirable.

Figure 1:
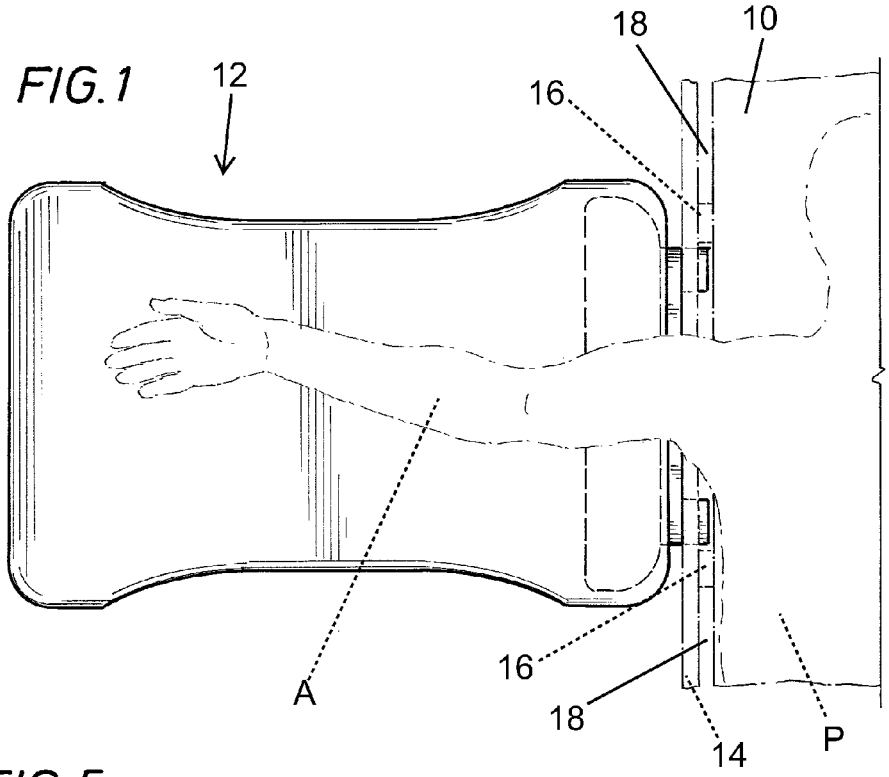
FIG. 1 is a top, plan environmental view showing an armboard mounted to an operating table rail using the mounting bracket of the present invention.

Referring first to FIG. 1, there is shown an environmental view of the armboard assembly of the present invention, connected to an operating table shown in phantom as 10, with a patient P resting on operating table 10. The arm A of the patient P extends laterally outwardly from the operating 10 and rests on an armboard shown generally as 12. As is typical, operating table 10 is provided with a side rail 14 which is connected to the side of the operating table 10 by a series of standoffs or connectors 16 thereby providing a series of longitudinally extending spaces 18 between the side rail 14 and the side of the operating table 10. It will be appreciated that the standoffs or connectors 16 which connect the side rail 14 to the operating table 10 limit where any type of clamping bracket can be connected to the side rail 14 and, accordingly, would limit where an armboard such as armboard 12 could be positioned along the length of operating table 12. As noted above, in performing limb surgery on hands, arms, and the like, it is important that the position of the patient's arm, which generally extends laterally out from the operating table, be at the proper location such that doctors, other operating personnel and auxiliary equipment can be optimally positioned relative to the patient. This result can be accomplished with the mounting bracket and the armboard assembly of the present invention.

Figure 2:
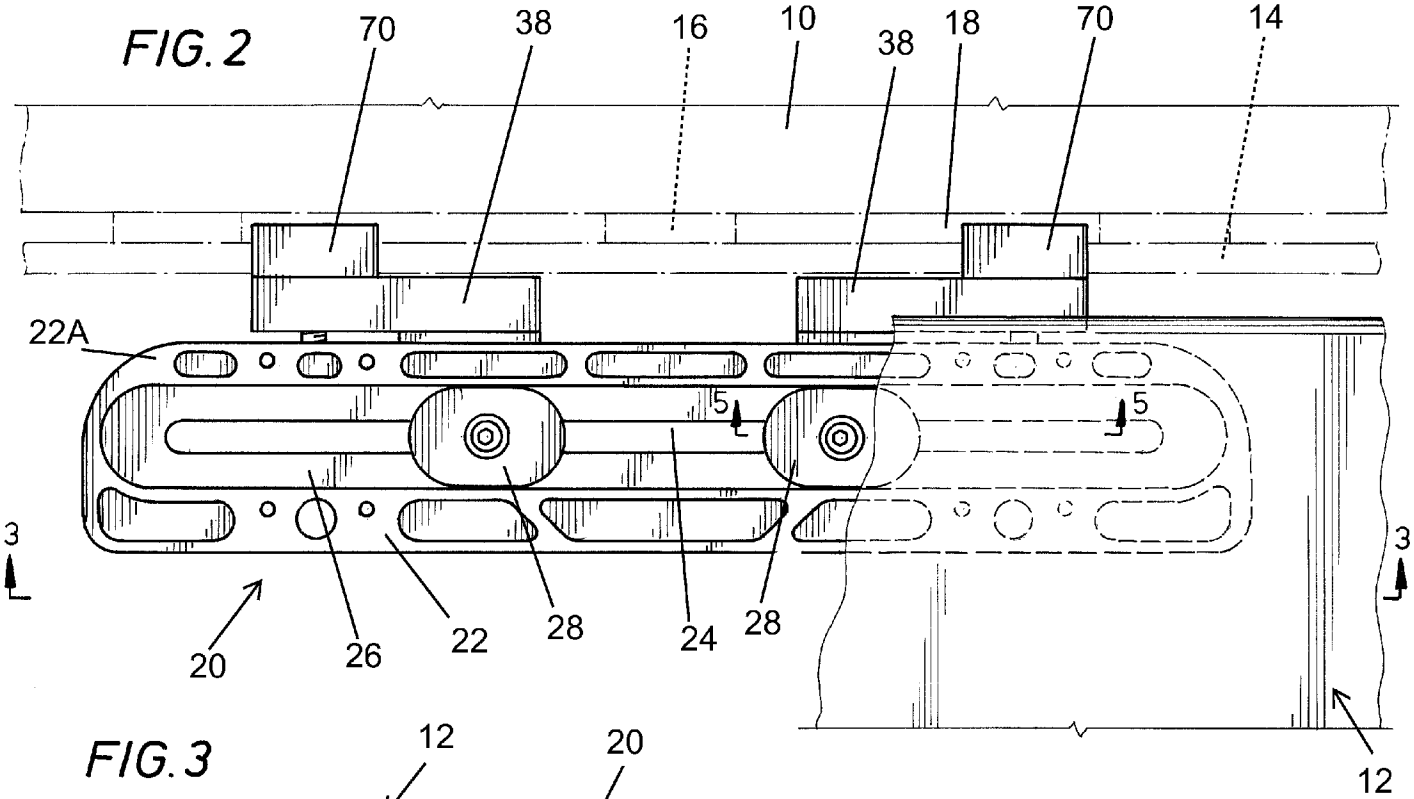
FIG. 2 is a top plan view, partly in section, showing the mounting bracket of the present invention attached to an operating table rail.

Referring now to FIG. 2, the mounting bracket shown generally as 20 comprises an elongate base 22, base 22 having an elongate slot 24 running generally along the length of base 22, slot 24 being formed in an elongate channel 26 formed in the top 28 of base 22. Received in channel 26 are a pair of generally oval shaped anchor plates 28 and 30 for reasons described more fully hereafter. Base 22 also has a top 22A and a bottom 22B (see FIG. 4)

As will be seen hereafter, the mounting bracket of the present invention comprises first and second attachment assemblies which are adjustably connected to the base 22 and which are substantially identical in construction. Each of the attachment assemblies comprises a locking assembly to lock the attachment assembly at a desired location along the slot 24 of base 22, and a clamping assembly to engage and clamp the attachment assembly to the side rail 14. Accordingly, only one of the attachment assemblies will be described, it being understood, as noted above, that the construction and the parts of the other attachment assembly are identical.

Figure 3:
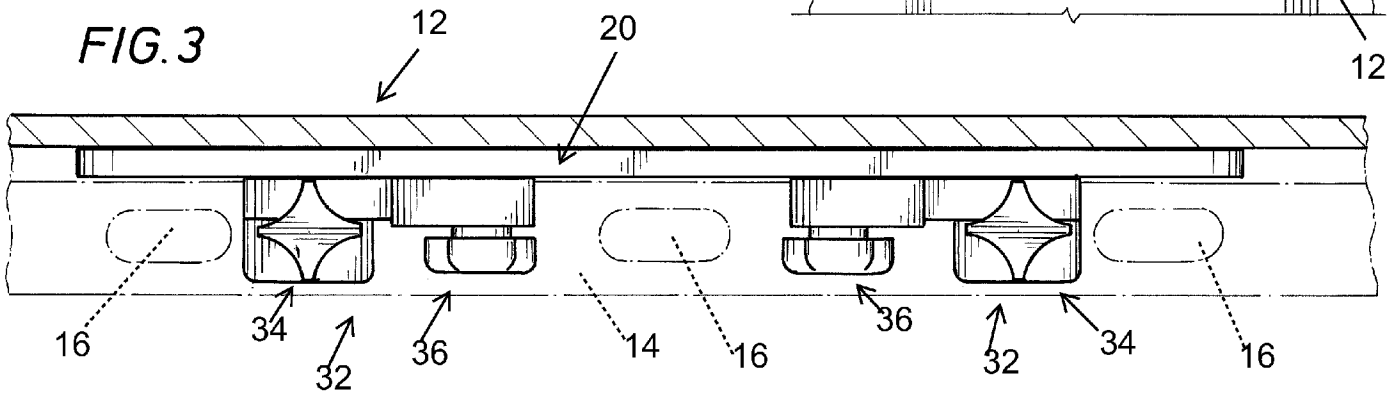
FIG. 3 is a cross-sectional view, taken along the lines 3-3 of FIG. 2.
Figure 4:
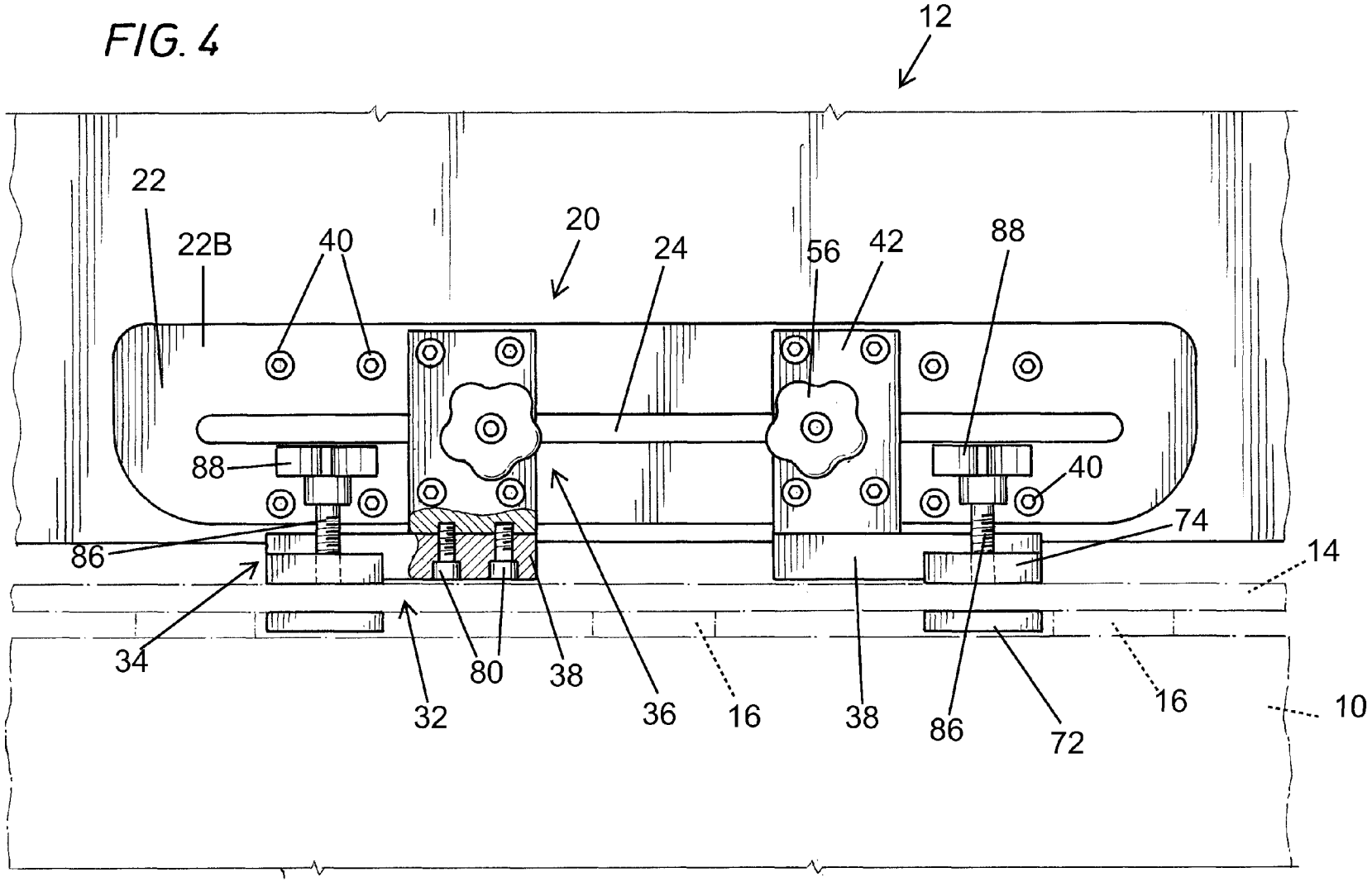
FIG. 4 is a bottom plan view, partly in section, of the mounting bracket of the present invention attached to the operating table rail.

With reference to FIGS. 3 and 4, the attachment assemblies, shown generally as 32 comprise the locking assembly, shown generally as 34, and the clamping assembly, shown generally as 36. A bridge piece 38 connects the locking assembly 34 to the clamping assembly 36. As can be seen in FIG. 4, base 22 is affixed to the underside of armboard 12 by means of screws 40.

Figure 5:
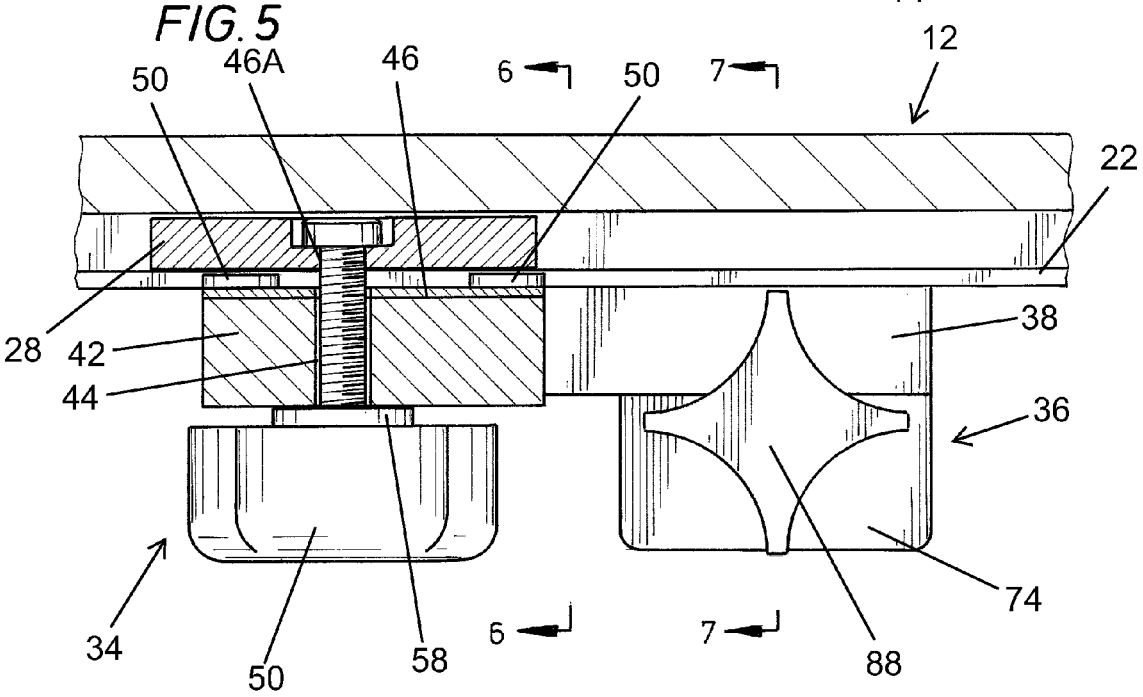
FIG. 5 is a cross-sectional view taken along the lines 5-5 of FIG. 2.
Figure 6:
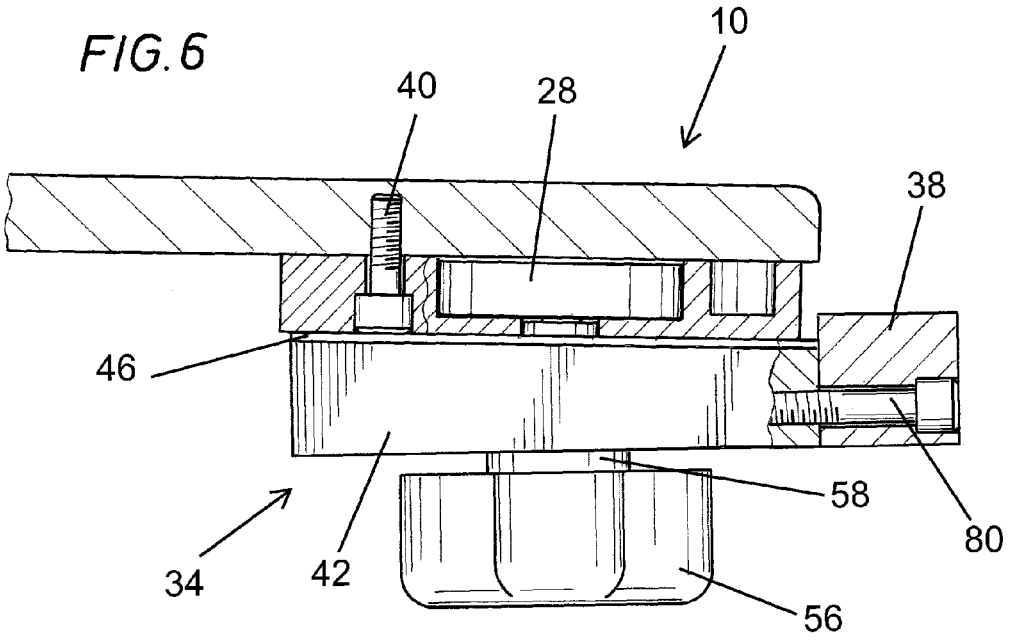
FIG. 6 is a cross-sectional view taken along the lines 6-6 of FIG. 5.

Referring now to FIGS. 5 and 6, there is shown the locking assembly 34 in greater detail. Locking assembly 34 comprises an adapter block 42 having a bore 44 therethrough. A spacer plate 46, attached to adapter block 42 by means of screws 48 (see FIG. 7) is provided with legs or projections 50 which are received in slot 24. A bolt 52 is threadedly secured in anchor plate 46 at 46A and extends through bore 44, a handle 56 being threadedly attached to bolt 52. It will thus be seen that rotation of handle 56 will force handing bearing extension 58 against plate 42, resulting in the head 52A of bolt 52 exerting a force against anchor plate 28 such that base 22 will now be sandwiched in compression between anchor plate 28, spacer plate 46, and block 42. This effectively locks attachment assembly 32 at a predetermined location along base 22. It will be understood that feet 50 which are received in slot 24 serve as guides as attachment assembly 32 is moved along the length of base 22. Further, it will be appreciated that anchor plates 28, which are essentially racetrack shaped in plan view, are sized such that their long sides fit in channel 26 and therefore are not free to rotate. Accordingly, the turning of handle 56 concomitantly turns handle bearing extension 58, thereby applying a compressive force, as described above, against the top 22A and bottom 22B of base 22 and effectively locking the attachment assembly 32 in a desired location.

As noted above, a typical operating table rail, e.g., rail 14 is connected to the operating table by standoffs or connectors 16, thereby forming a series of longitudinally extending spaces 18 between operating table 10 and rail 14. It will thus be appreciated that by moving the attachment assemblies 32 along the length of the rail 14 in the spaces 18 between the operating table 10 and the rail 14, the armboard can be positioned at the desired location.

Figure 7:
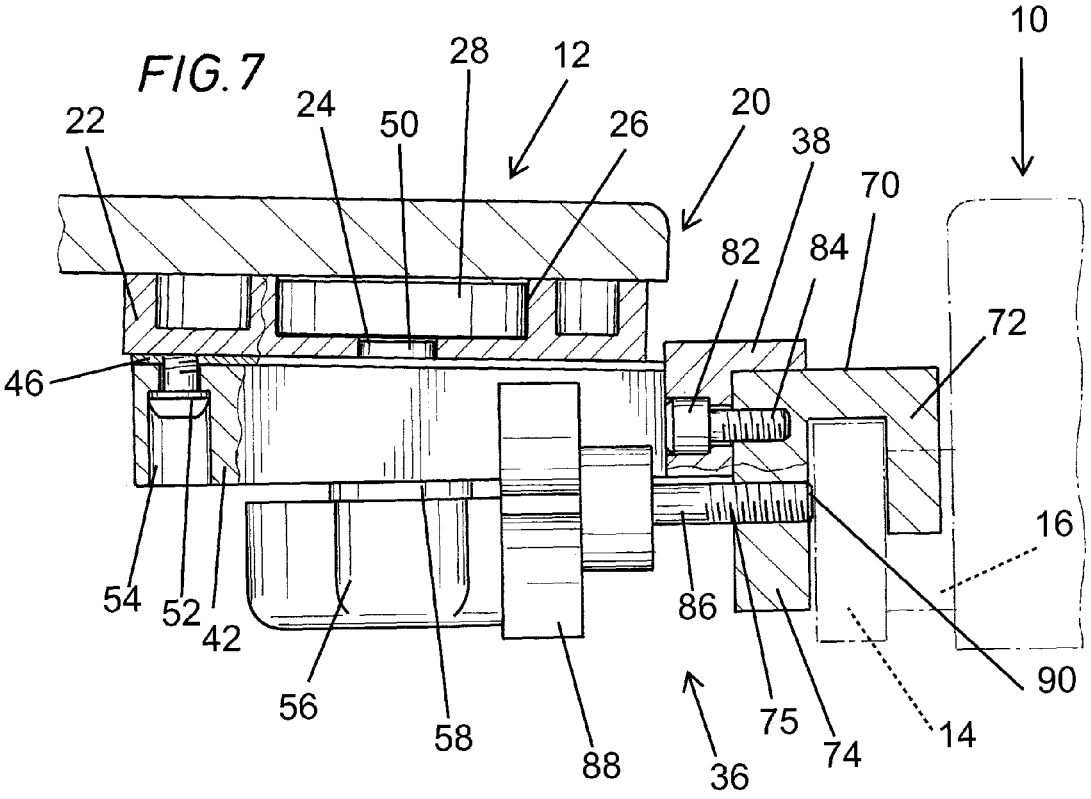
FIG. 7 is a cross-sectional view taken along the lines 7-7 of FIG. 5.

Referring now to FIG. 7, there is shown in greater detail, the clamping assembly 34. Clamping assembly 36 includes a U-shaped jaw 70 having spaced apart legs 72 and 74, and a gap 76 formed therebetween. As can be seen by reference to FIG. 7, in use the gap 76 receives the side rail 14. Jaw 70 is connected by bridge 38 to block 42 of the locking assembly 34. In this regard, as can be seen in FIG. 6, bolts 80 received in bores in bridge 38 are threadedly received in the threaded bore in block 42. In a similar fashion, bolts 82 received in bores in bridge 38 are threadedly received into threaded bore 84 in jaw 70.

Leg 74 of jaw 70 has a threaded bore 75 therein in which is threadedly received the spindle 86 of a second handle 88. It will be appreciated that if handle 88 is rotated in the correct direction, since it is fixedly connected to spindle 86, spindle 86 will be rotated and advance into threaded bore 75 until the end 90 of spindle 86 engages rail 14. Continued rotation will compress rail 14 between leg 72 and the end 90 of spindle 86, As will also be appreciated, this compressive force is orthogonal to the compressive force exerted by rotating handle 56 of locking assembly 34.

As can be seen from the above, the clamping bracket of the present invention, greatly facilitates positioning of an armboard at a proper location relative to the operating table, such that the arm of a patient can be properly positioned. In this regard, it will be appreciated that in the case where two attachment assemblies are employed, which would be the normal case with an armboard, since the attachment assemblies are independently adjustable along the base, each of the attachment assemblies can be positioned such that it can engage and clamp the side rail of the operating table at any location, limited only by the standoffs between the rail and the operating table. Nonetheless, the dual adjustability by the two attachment assemblies virtually ensures that the armboard assembly can be secured to the side rail exactly at the desired location regardless of the location of the standoffs. Furthermore, the mounting bracket of the present invention provides both of what may be considered a coarse and a fine adjustment. For example, the armboard assembly could be first attached to the rails at a desired location which approximated where the armboard should be attached relative to the operating table. Once in this position, the clamping assemblies could be engaged to clamp the attachment assemblies at that position. However, the mounting bracket of the present invention further provides for fine adjustment of that position since the armboard can be moved longitudinally along the length of the base of the mounting bracket as long as the locking assemblies are not fully engaged. Thus, once the armboard is precisely positioned, the locking assemblies can then be tightened, ensuring optimal positioning of the armboard relative to the operating table. Further, the dual attachment assemblies ensure rigid connection of the armboard assembly to the rail of the operating table obviating the need for legs or the like underneath the armboard to support the armboard. As noted, such legs are prone to being kicked and further take up space adjacent the operating table that is often needed for auxiliary operating equipment. Furthermore, the clamping bracket of the present invention helps ensure that the arm board and hence the arm of the patient resting on the armboard is angled slightly upwardly relative to the operating table to again provide the surgeon with the most desired attitude of the arm relative to the patient. In this regard, and with reference to FIG. 6, it can be seen that adapter block 42 is tapered such that when the armboard is locked into position at the desired location on the rail 14, armboard 12 is at a slight upward angle such that the patient's arm is slightly elevated relative to the level of the operating table.

While the invention has been described with particular reference to a clamping bracket for clamping an armboard to an operating table, it is to be understood that the clamping bracket of the present invention could also be used to support a piece of equipment, therapeutic device or the like on a suitable support surface adjacent the operating table. Again, the ease with which the clamping bracket of the present invention can be moved longitudinally along the length of the operating table increases its utility for a wide variety of uses.

While the invention has been described with respect to two attachment assemblies 32, each having a locking assembly 34 and a clamping assembly 36, it will be understood that it is not so limited. There could be occasions where a single attachment assembly could be employed, i.e., there would be only one locking assembly and one clamping assembly. However, in the normal case with an armboard, to ensure a rigid attachment of the armboard to the side rail of the operating table, it is generally desirable that two attachment assemblies 32 be employed.

Although specific embodiments of the invention have been described herein in some detail, this has been done solely for the purposes of explaining the various aspects of the invention, and is not intended to limit the scope of the invention as defined in the claims which follow. Those skilled in the art will understand that the embodiment shown and described is exemplary, and various other substitutions, alterations and modifications, including but not limited to those design alternatives specifically discussed herein, may be made in the practice of the invention without departing from its scope.

What is claimed is:

1. A clamping bracket comprising:

an elongate base having a top and a bottom, said base having a slot extending longitudinally therealong, said base being adapted to be attached to an object such that said top faces said object; and at least one first attachment assembly connected to said base, said first attachment assembly comprising:

a first locking assembly slidable along said slot to selectively lock said first attachment assembly at a desired location along said slot and apply a first compressive force to said top and bottom of said base; and a first clamping assembly, said first clamping assembly including a first jaw having a receiving formation adapted to receive a member to be clamped and a first compression assembly connected to said first jaw and operative to apply a second compressive force against said member in said first jaw, said second compressive force acting in a direction generally orthogonal to said first compressive force;

said first locking assembly and said first clamping assembly being connected to one another such that sliding said first locking assembly along said slot in one direction moves said first clamping assembly in the same direction.

2. The clamping bracket of claim 1 comprising a second attachment assembly connected to said base, said second attachment assembly comprising:

a second locking assembly slidable along said slot to selectively lock said second attachment assembly at a desired location along said slot and apply a third compressive force to said top and bottom of said base; and a second clamping assembly, said second clamping assembly including a second jaw having a receiving formation adapted to receive said member to be clamped and a second compression assembly connected to said second jaw and operative to apply a fourth compressive force against said member in said second jaw, said fourth compressive force acting in a direction generally orthogonal to said third compressive force;

said second locking assembly and said second clamping assembly being connected to one another such that sliding said second locking assembly along said slot in one direction moves said second clamping assembly in the same direction.

3. The clamping bracket of claim 2, wherein said first and second locking assemblies are independently slidable along said slot.

4. The clamping bracket of claim 3, wherein each of said locking assemblies comprises a compression assembly comprising an anchor disposed on the top of said base, a rod connected to said anchor and extending through said slot, said rod having a threaded portion distal said bottom of said base and a tightener threadedly received on said threaded portion of said rod and operative to apply a force in the direction toward the bottom of said base.

5. The clamping bracket of claim 4, wherein each of said locking assemblies further comprise an adapter block having a bore therethrough, said rod extending through said bore, and said tightener comprising a first handle connected to said rod.

6. The clamping bracket of claim 5, wherein there is a spacer plate disposed between said adapter block and said base and connected to said adapter block.

7. The clamping bracket of claim 6, wherein said spacer plate comprises projecting formations received in said slot.

8. The clamping bracket of claim 5, wherein each of said locking assemblies has a bridge connecting said adapter block to said jaw.

9. The clamping bracket of claim 4, wherein said base includes an elongate channel formed in said top of said base and extending longitudinally therealong and said anchors are received in said channel.

10. The clamping bracket of claim 2, wherein each of said jaws is generally U-shaped having first and second spaced legs forming a gap therebetween.

11. The clamping bracket of claim 10, wherein said first leg of said jaw has a threaded bore and said compression assembly comprises a tightening assembly threadedly received in said bore to engage a member received in said gap.

12. The clamping bracket of claim 11, wherein said tightener comprises a threaded shaft and a second handle connected to said threaded shaft.

13. An adjustable armboard assembly for connecting to an operating table having a side rail, said assembly comprising:

an armboard having a top side and a bottom side;

a clamping bracket, said clamping bracket comprising an elongate base having a top and a bottom, said base having a slot extending longitudinally therealong, said base being attached to said bottom side of said armboard such that the top faces said underside of said armboard, said clamping bracket further comprising at least one first attachment assembly connected to said base, said first attachment assembly comprising:

a first locking assembly slidable along said slot to selectively lock said first attachment assembly at a desired location along said slot and apply a first compressive force to said top and bottom of said base;

a first clamping assembly, said first clamping assembly including a first jaw having a receiving formation adapted to receive said side rail to be clamped and a first compression assembly connected to said first jaw and operative to apply a second compressive force against said side rail in said first jaw, said second compressive force acting in a direction generally orthogonal to said first compressive force;

said first locking assembly and said first clamping assembly being connected to one another such that sliding said first locking assembly along said slot in one direction moves said first clamping assembly in the same direction;

a second attachment assembly connected to said base, said second attachment assembly comprising:

a second locking assembly slidable along said slot to selectively lock said second attachment assembly at a desired location along said slot and apply a third compressive force to said top and bottom of said base; and a second clamping assembly, said second clamping assembly including a second jaw having a receiving formation adapted to receive said side rail and a second compression assembly connected to said second jaw and operative to apply a fourth compressive force against said side rail in said second jaw, said fourth compressive force acting in a direction generally orthogonal to said third compressive force;

said second locking assembly and said second clamping assembly being connected to one another such that sliding said second locking assembly along said slot in one direction moves said second clamping assembly in the same direction.

* * * * *